US008695156B2

(12) United States Patent
Marshall et al.

(10) Patent No.: US 8,695,156 B2
(45) Date of Patent: Apr. 15, 2014

(54) AEROACOUSTIC DUSTER

(76) Inventors: Jeffrey S. Marshall, Jericho, VT (US); Di Chen, Colchester, VT (US); Nicholas Mario Vachon, Barre, VT (US); Darren Hitt, Jericho, VT (US); Junru Wu, South Burlington, VT (US)

( * ) Notice: Subject to any disclaimer, the term of this patent is extended or adjusted under 35 U.S.C. 154(b) by 324 days.

(21) Appl. No.: 13/024,072

(22) Filed: Feb. 9, 2011

(65) Prior Publication Data

US 2011/0214246 A1 Sep. 8, 2011

Related U.S. Application Data

(60) Provisional application No. 61/303,004, filed on Feb. 10, 2010.

(51) Int. Cl.
*A47L 5/14* (2006.01)
*F15D 1/00* (2006.01)

(52) U.S. Cl.
USPC ..... 15/345; 15/339

(58) Field of Classification Search
USPC ..... 15/300.1, 316.1, 345, 404, 405, 339
IPC ..... A47L 5/14; F15D 1/00
See application file for complete search history.

(56) References Cited

U.S. PATENT DOCUMENTS 3,959,010 A * 5/1976 Thompson et al. ..... 134/21
4,240,299 A * 12/1980 Joy et al. ..... 73/861.23
4,364,147 A * 12/1982 Biedermann et al. ..... 15/404
4,677,704 A * 7/1987 Huggins ..... 15/1.51
4,928,402 A 5/1990 Allen
5,246,514 A * 9/1993 Alderman et al. ..... 156/73.1
5,297,739 A 3/1994 Allen
5,384,593 A * 1/1995 Gell et al. ..... 348/61
5,388,304 A * 2/1995 Takada ..... 15/345
5,400,466 A * 3/1995 Alderman et al. ..... 15/363
5,457,847 A * 10/1995 Uzawa et al. ..... 15/345
5,504,972 A * 4/1996 Tada et al. ..... 15/404
5,685,039 A * 11/1997 Hamada et al. ..... 15/88.2
5,701,358 A * 12/1997 Larsen et al. ..... 381/423
5,769,913 A * 6/1998 Gallego Juarez et al. ..... 96/389
5,910,648 A * 6/1999 Moritz ..... 181/175
5,956,863 A * 9/1999 Allen ..... 34/97
6,024,796 A * 2/2000 Salazar et al. ..... 118/326
6,360,763 B1 * 3/2002 Narayanan et al. ..... 137/13
6,390,418 B1 * 5/2002 McCormick et al. ..... 244/204
6,643,893 B2 * 11/2003 Momonoi et al. ..... 15/303
6,729,839 B1 * 5/2004 Illingworth et al. ..... 415/1
7,111,797 B2 * 9/2006 Bezama et al. ..... 239/522

(Continued)

FOREIGN PATENT DOCUMENTS

JP 11325530 A * 11/1999

*Primary Examiner* — Joseph J Hail
*Assistant Examiner* — Marc Carlson

(57) ABSTRACT

The aero-acoustic duster invention disclosed herein provides for high particle removal rate from surfaces with low energy expenditure relative to competing vacuum-based devices. The device removes particulate matter from a surface using a two-step process: 1. Acoustic radiation is used to break the adhesive bonds between dust and the surface, forcing particles into a mode where they continuously bounce up and down on the surface; and, 2. A bounded vortex is generated over the surface, with suction in the vortex center and jets for blowing air along the periphery. The jets are tilted in the tangential direction to induce vortex motion within the suction region. The vortex is said to be bounded because streamlines originating in the downward jets are entrained back into the central vortex.

10 Claims, 10 Drawing Sheets

(56) References Cited

U.S. PATENT DOCUMENTS

| | | | | |
|---|---|---|---|---|
| 7,143,470 | B2 * | 12/2006 | Bosses | 15/364 |
| 7,234,198 | B2 * | 6/2007 | Bosses | 15/364 |
| 7,383,607 | B2 * | 6/2008 | Johnson | 15/345 |
| 7,466,837 | B2 * | 12/2008 | Nakamura | 381/337 |
| 7,552,503 | B2 * | 6/2009 | Wakao et al. | 15/302 |
| 2002/0092449 | A1 * | 7/2002 | Gutmark et al. | 110/346 |
| 2004/0069069 | A1 * | 4/2004 | Gysling et al. | 73/736 |
| 2004/0195351 | A1 * | 10/2004 | Leonard et al. | 239/102.1 |
| 2005/0011278 | A1 * | 1/2005 | Brown et al. | 73/861.18 |
| 2005/0087287 | A1 * | 4/2005 | Lennon et al. | 156/167 |
| 2005/0150830 | A1 * | 7/2005 | Laugharn et al. | 210/634 |
| 2005/0251952 | A1 * | 11/2005 | Johnson | 15/379 |
| 2005/0278892 | A1 * | 12/2005 | Bosses | 15/364 |
| 2006/0248676 | A1 * | 11/2006 | Baek | 15/319 |
| 2008/0017031 | A1 * | 1/2008 | Vo | 95/148 |
| 2008/0121220 | A1 * | 5/2008 | Wilder et al. | 124/77 |
| 2010/0005616 | A1 * | 1/2010 | Grissom | 15/344 |
| 2010/0011845 | A1 * | 1/2010 | Laugharn et al. | 73/64.53 |
| 2010/0306955 | A1 * | 12/2010 | Menrik et al. | 15/347 |
| 2011/0108023 | A1 * | 5/2011 | McKinney et al. | 128/200.14 |
| 2011/0186436 | A1 * | 8/2011 | Novosselov et al. | 204/600 |
| 2011/0258808 | A1 * | 10/2011 | Makita et al. | 15/339 |

* cited by examiner

Silicon Wafer

Commercial Solar Panel

Synthetic Leather

Teflon

AEROACOUSTIC DUSTER

CROSS-REFERENCE TO RELATED APPLICATIONS

The present application is related to, claims the earliest available effective filing date(s) from (e.g., claims earliest available priority dates for other than provisional patent applications; claims benefits under 35 USC §119(e) for provisional patent applications), and incorporates by reference in its entirety all subject matter of the following listed application(s) (the "Related Applications") to the extent such subject matter is not inconsistent herewith; the present application also claims the earliest available effective filing date(s) from, and also incorporates by reference in its entirety all subject matter of any and all parent, grandparent, great-grandparent, etc. applications of the Related Application(s) to the extent such subject matter is not inconsistent herewith.

1. U.S. provisional patent application 61/303,004, entitled "Aeroacoustic Duster", naming Jeff Marshall, Darren Hitt, Jun-ru Wu, Nick Vachon, and Di Chen as inventors, filed 10 Feb. 2010.

REFERENCE TO U.S. GOVERNMENT INTEREST

"The U.S. Government has a paid-up license in this invention and the right in limited circumstances to require the patent owner to license others on reasonable terms as provided for by the terms of Grant NNX08AZ07A awarded by NASA."

BACKGROUND

1. Field of Use

These teachings relate generally to a system and method for high particle removal rate from surfaces with low energy expenditure. More specifically, these teachings relate to acoustic radiation and a bounded vortex for high particle removal rates.

2. Description of Prior Art (Background)

Conventional vacuum cleaners make a relatively high impact contact with the surface being cleaned. Hence, conventional vacuum cleaners cause considerable surface wear. In addition, conventional vacuum cleaners and brushes have recently been cited as a source of bacteria breeding areas. Therefore, there exists a need for dust mitigation in residential and industrial applications subject to dust build-up, or for applications for optical materials or delicate electronic instrumentation for which contact is undesirable.

BRIEF SUMMARY

The foregoing and other problems are overcome, and other advantages are realized, in accordance with the presently preferred embodiments of these teachings. The aero-acoustic duster device is intended to provide for high particle removal rate from surfaces with low energy expenditure relative to competing vacuum-based devices. The device removes particulate matter from a surface using a two-step process:

1. Acoustic radiation is used to break the adhesive bonds between dust and the surface, forcing particles into a mode where they continuously bounce up and down on the surface.
2. A bounded vortex is generated over the surface, with suction in the vortex center and jets for blowing air along the periphery. The jets are tilted in the tangential direction to induce vortex motion within the suction region. The vortex is said to be bounded because streamlines originating in the downward jets are entrained back into the central vortex.

By use of acoustic radiation force to levitate dust particles and break their adhesive bonds, the velocity of air flow necessary to remove the particles can be significantly lowered. The vortex acts to enhance shear stress under the suction region, hence increasing the ability of the air flow to entrain particles.

In accordance with one embodiment of the present invention an apparatus for efficiently removing dust particles is provided. The apparatus includes a tweeter for generating acoustic energy and a bounded vortex generator. The bounded vortex generator includes an acoustic emitter for emitting the acoustic energy provided by the tweeter, a plurality of tilted jets for providing tangential air flow across a dusted substrate, and a vacuum port for vacuuming dust excited by the acoustic energy and tangential air flow combination.

The invention is also directed towards a system for removing dust particles. The system includes a tweeter having an acoustic generator for generating sound waves. The acoustic generator includes at least one continuous wave (CW) acoustic generator and at least one frequency modulated (FM) acoustic generator. The system also includes a bounded vortex generator coupled to the tweeter. The tweeter includes an acoustic emitter for emitting acoustic energy; a vacuum port for removing dust; and a plurality of tilted jets surrounding the acoustic emitter for providing a tangential air flow to a surface.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

Figure 1:
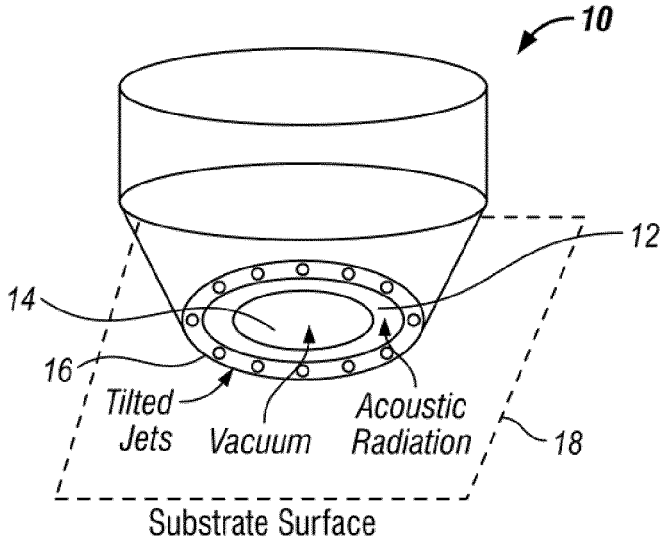
FIG. 1 is a pictorial illustration of one embodiment of the present non-contact aero-acoustic duster invention.

Referring to FIG. 1 there is shown a pictorial illustration of one embodiment of the present non-contact aero-acoustic duster invention. The duster 10 is suspended about 1 cm above a surface 18. The underside of the duster has three active regions: suction port 14; acoustic emitter 12; and tilted jets 16, each of which is of the form of tangential concentric bands or regions as shown in FIG. 1. The centermost region, the suction region 14, leads to a filter similar to that used in traditional vacuum cleaners. The second region, is the acoustic emitter 12 for emitting acoustic radiation at the surface. The third region consists of N tangentially-oriented jets 16, which draw air from the filter exhaust and create a bounded vortex with suction in the center of the suction port 14.

The aero-acoustic duster 10 can be used in the same manner that a vacuum cleaner is used, ranging from small hand-held devices to larger-push-type devices. It may also be incorporated in a mechanical translation device (e.g., arm) to allow for automated cleaning. Unlike conventional vacuum cleaners, the aero-acoustic duster makes no contact with the surface being cleaned. Hence, the aero-acoustic duster 10 does not cause surface wear and is suitable for use on all types of surfaces. The latter fact will make this device particularly useful for dust mitigation in industrial applications subject to dust build-up, or for applications for optical materials or delicate electronic instrumentation for which contact is undesirable.

Vortex Optimization:

The bounded vortex generation device 16 is optimized to provide a strong vortex flow with optimal surface shear stress. Numerical simulations using the computational fluid dynamics software FLUENT to generate the air flow with different number of jets and jet orientations and with different operating pressure differentials.

Figure 2A:
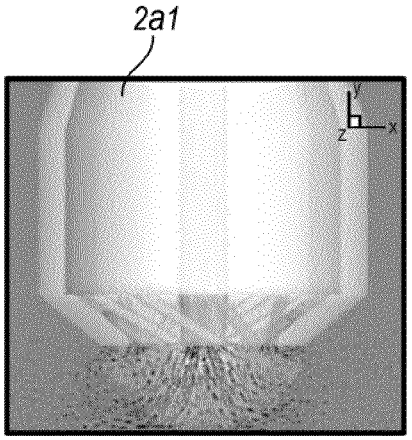
FIG. 2A is an illustration of a computed flow field generated by bound vortex device in accordance with the invention shown in FIG. 1.
Figure 2B:
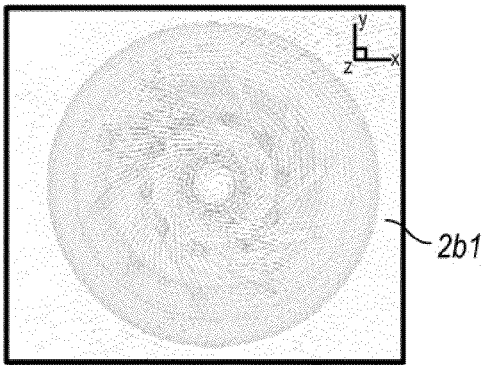
FIG. 2B is an illustration of the computed flow field corresponding vectors in a horizontal plane generated in accordance with the invention shown in FIG. 1.
Figure 2C:
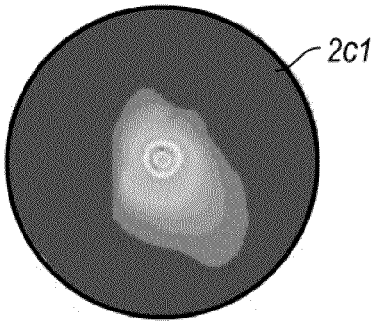
FIG. 2C is an illustration of the corresponding surface shear stress field in accordance with the invention shown in FIG. 1.
Figure 3A:
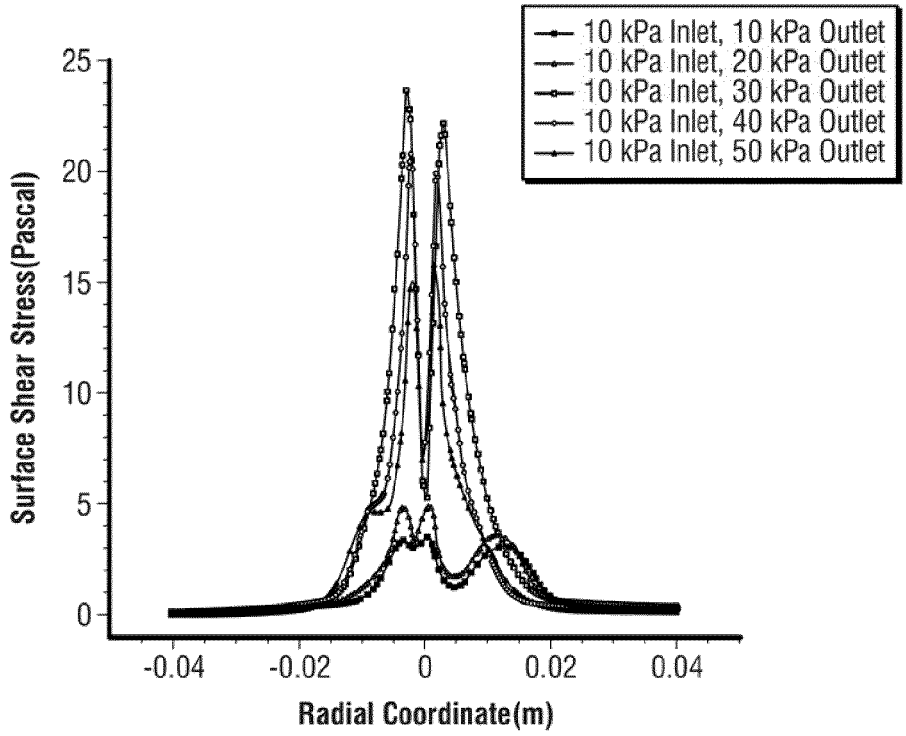
FIG. 3A is a graph of profiles of surface shear stress generated by bounded vortex device in accordance with the invention shown in FIG. 1.
Figure 3B:
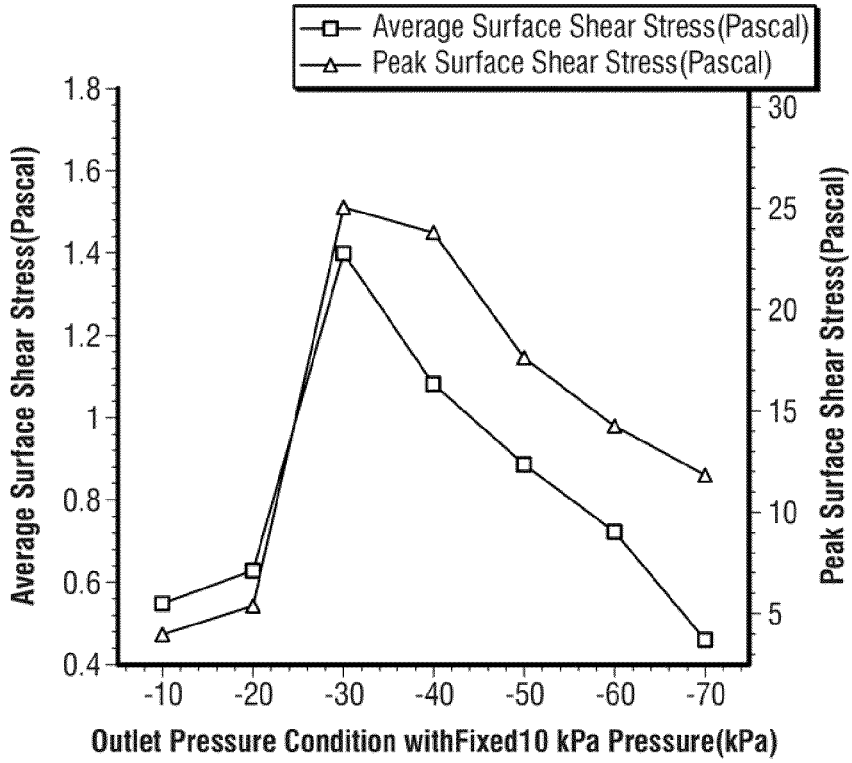
FIG. 3B is a line plot of maximum and average shear stress as function of outlet pressure in accordance with the invention shown in FIG. 1.
Figure 4B:
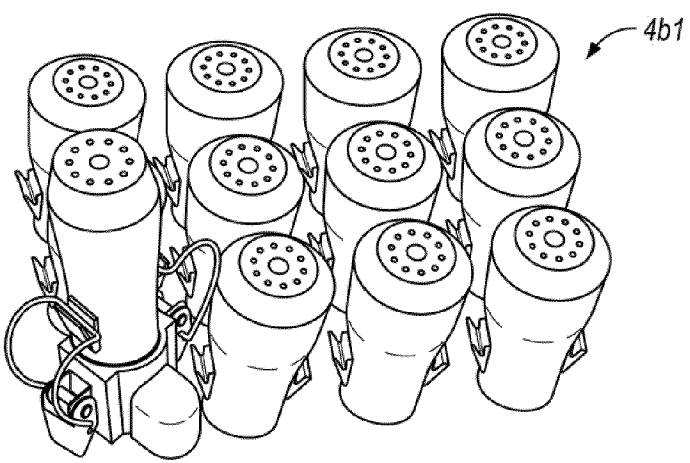
FIG. 4B is a schematic of a set of 12 prototype devices used for testing in accordance with the invention shown in FIG. 1.
Figure 4A:
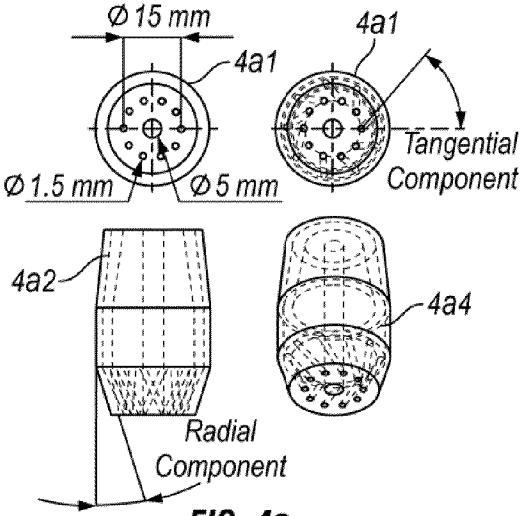
FIG. 4A is a schematic diagram of a bounded vortex device in accordance with the invention shown in FIG. 1.

The number of jets and jet tilt angles that provide the maximum shear stress on the substrate surface, which in turn provides the optimal entrainment of particles from the surface, is determined initially from numerical simulations using computational fluid dynamics software. However, it will be appreciated that any suitable number of jets and jet tilt angles that provide the maximum shear stress on the substrate surface, which in turn provides the optimal entrainment of particles from the surface, may be used. Plots of the flow field and substrate surface shear stress at the optimal condition are shown in FIGS. 2A, 2B, and 2C. Referring also to FIG. 3A, there is shown a graph of profiles of surface shear stress generated by bounded vortex device in accordance with the invention shown in FIG. 1. Also referring to FIG. 3B, there is shown a line plot of maximum and average shear stress as function of outlet pressure in accordance with the invention shown in FIG. 1. Twelve prototypes 4*b*1 of the bounded vortex generators are shown in FIG. 4*b*, each with different N tangentially-oriented jets 16 (see FIG. 1). Referring also to FIG. 4A there is shown a schematic diagram of a bounded vortex device in accordance with the invention shown in FIG. 1. Still referring to FIG. 4*a*, vortex lines 4*a*2 show relative airflow within vortex generator outer shell 4*a*1. It will be appreciated that the bounded vortex generator outer shell 4*a*1 may be any suitable material. It will also be appreciated that the internal structure represented by 4*a*4 may be any suitable internal structure. Finally, it will be understood, that the measurements shown in FIG. 4*a* are representative and should not be construed as limiting in any manner.

Acoustic Radiation Optimization

Figure 5A:
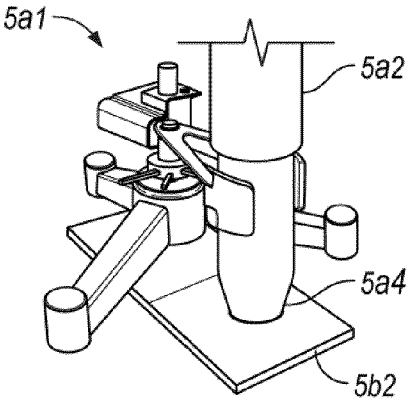
FIGS. 5A-5C are schematics of aerodynamic test set-up and results for bounded vortex device using lunar stimulant in accordance with the invention shown in FIG. 1.
Figure 5B:
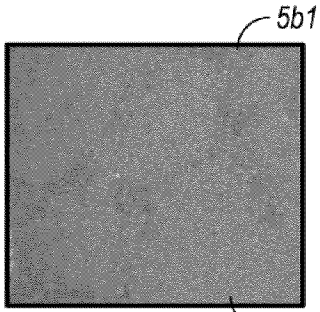
Figure 5C:
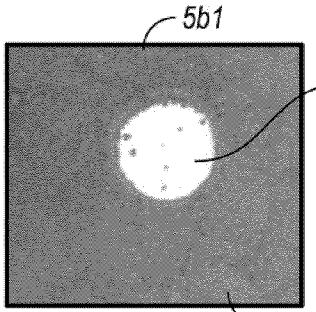

Referring also to FIG. 5A there is shown a schematics of aerodynamic test set-up 5*a*1 for bounded vortex generation device 5*a*4 and tweeter 5*a*2. It will be understood that weeter 5*a*2 may be any suitable acoustic generator. FIG. 5B shows a Plexiglas substrate 5*b*1 uniformly covered with simulated lunar dust 5*b*2. FIG. 5C shows result for bounded vortex device in accordance with the invention shown in FIG. 1. Still referring to FIG. 5C a weak air cross-flow was introduced to blow the particles off of the Plexiglas substrate 5*b*1 once the particles are acoustically levitated. The result shows nearly 100% particle removal from the area 5*c*1 where the particles were subjected to both the acoustic levitation and the air cross-flow.

Figure 6:
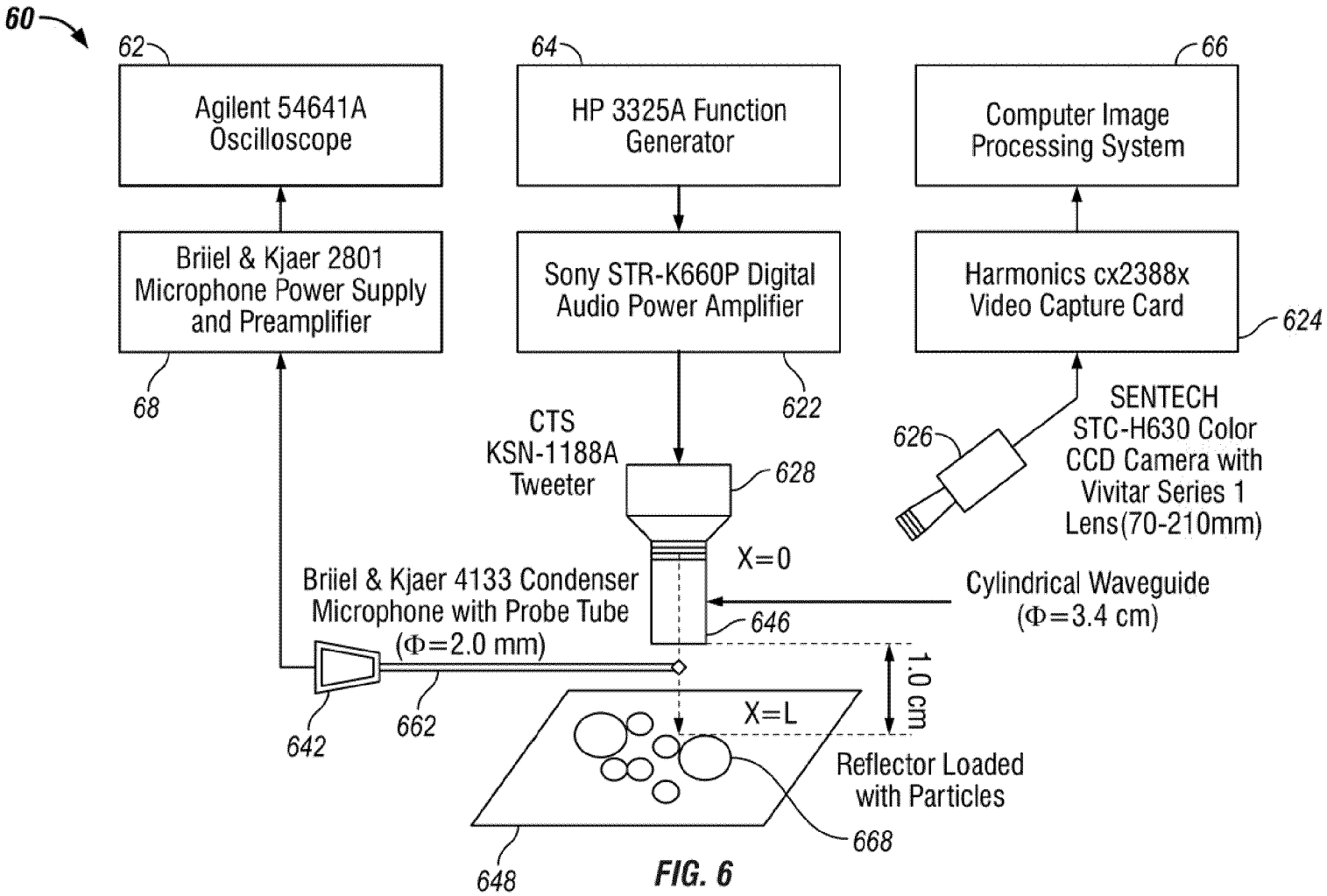
FIG. 6 is a block diagram of an experimental configuration for testing particle levitation by acoustic radiation emitted normal to a surface in accordance with the invention shown in FIG. 1.
Figure 7A:
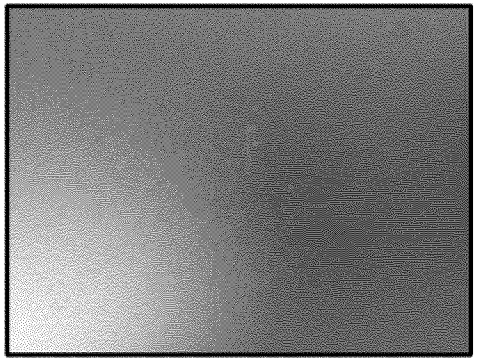
FIGS. 7A-7D are pictorial illustrations of four reflector surfaces used to validate the performance of the present invention shown in FIG. 1: silicon wafer (FIG. 7A), commercial solar panel (FIG. 7B), synthetic leather (FIG. 7C) and Teflon (FIG. 7D), respectively.
Figure 7B:
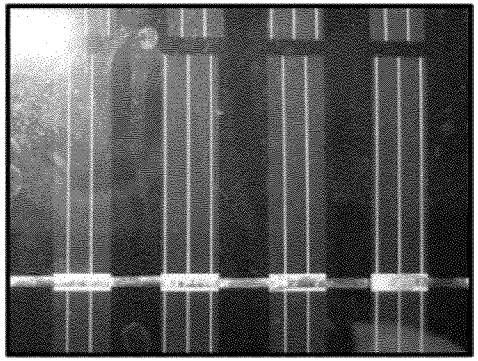
Figure 7C:
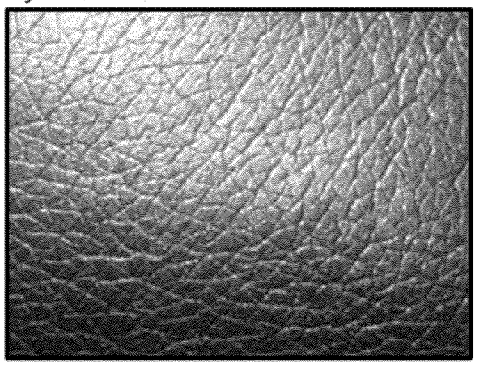
Figure 7D:
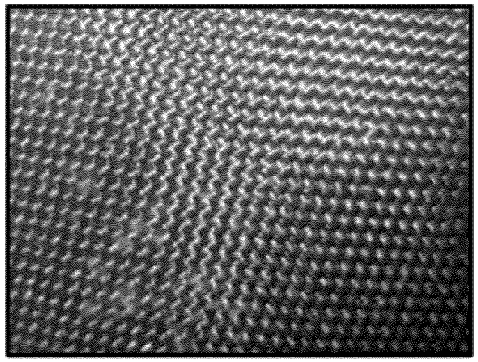
Figure 8A:
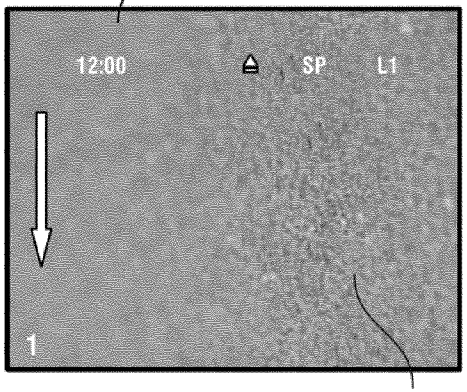
FIGS. 8A-8F are pictorial illustrations of a sequence of particle removal of Mars dust stimulants lodged on a silicon wafer in accordance with the present invention shown in FIG. 1.
Figure 8B:
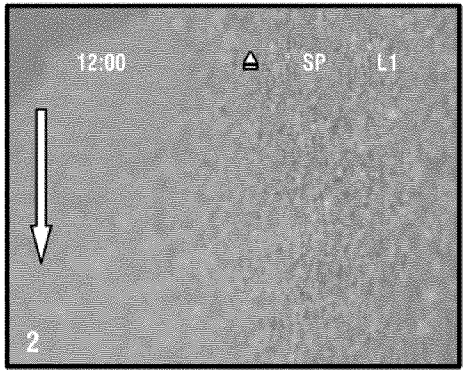
Figure 8C:
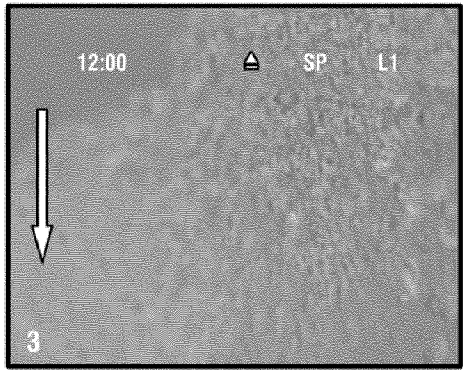
Figure 8D:
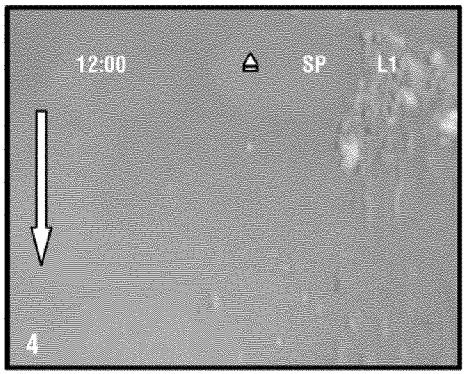
Figure 8E:
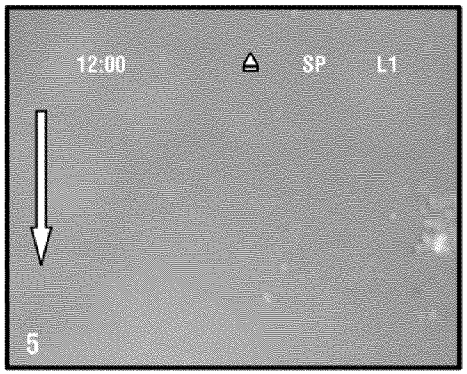
Figure 8F:
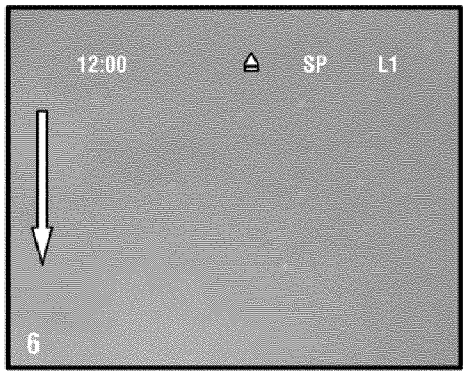

Referring also to FIG. 6 there is shown a block diagram of an experimental configuration for testing particle levitation by acoustic radiation emitted normal to a surface in accordance with the invention shown in FIG. 1. The experimental configuration included an oscilloscope 62, a microphone power supply and pre-amplifier 68, a microphone 642, a probe tube 662, a function generator 64, a audio power amplifier 622, a computer processing imaging system, a video capture card 624, and a CCD camera 626. A weak air cross-flow was introduced to blow the particles 668 off of the test surface 648 once the particles were levitated by tweeter 628 and waveguide 646, respectively. The tests were conducted for both Martian and simulated lunar dust composed of dry particles with diameter ranging from 1-100 □m.

Referring also to FIGS. 7A-7D there are shown pictorial illustrations of four reflector surfaces used to validate the performance of the present invention shown in FIG. 1: silicon wafer (FIG. 7A), commercial solar panel (FIG. 7B), synthetic leather (FIG. 7C) and Teflon (FIG. 7D), respectively. All parameters including L (See FIG. 6), frequency and acoustic intensity were kept the same for all four materials. Each reflector was exposed to the acoustic excitation and air flow for 90 seconds during the removal operation. Size distributions of the residual particles after removal on the reflectors were studied by direct counting.

Referring also to FIGS. 8A-8F there are shown pictorial illustrations of a sequence of particle removal of Mars dust stimulants 8*a*1, 8*a*2 lodged on a silicon wafer in accordance with the present invention shown in FIG. 1. FIGS. 8A-8F contains 6 images taken in sequence when silicon wafer was chosen as the reflector. The arrow represents the air flow direction. Air flow was continuously on for all 6 images were taken and acoustic signal was continuously turned on starting at images 2, FIG. 8*b*. There was no particles' movement at the time when image 1, FIG. 8*a* was taken when only air flow was on. Particles began to be removed as soon as the tweeter (FIG. 6, item 628) was turned on as shown in images 2-6. It will be appreciated that Mars dust simulants were removed effectively by the air flow after the dust simulants were levitated by the standing wave acoustic field.

Figure 9A:
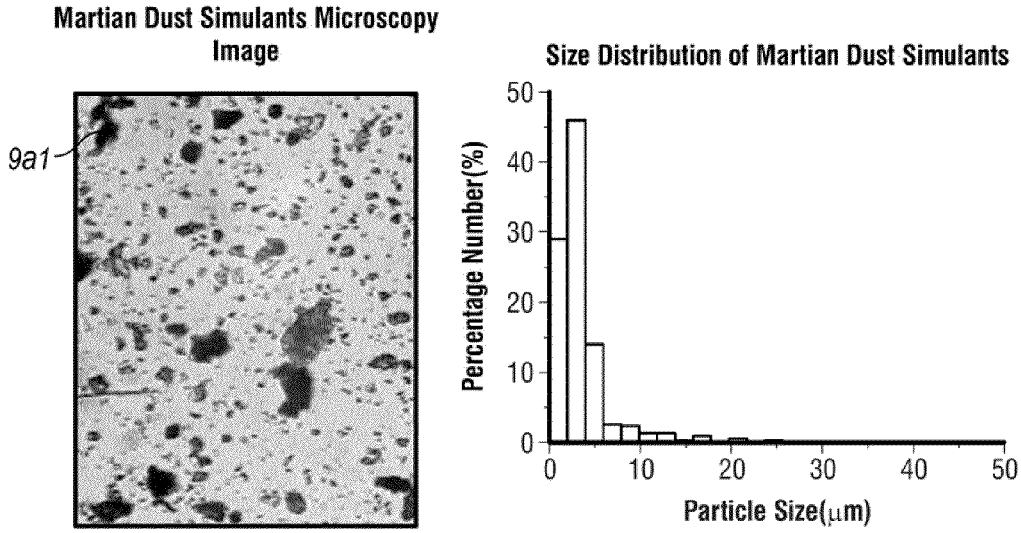
FIG. 9A is a pictorial illustration of images of Mars dust stimulants accompanied with the percent-number size-distribution histogram.
Figure 9B:
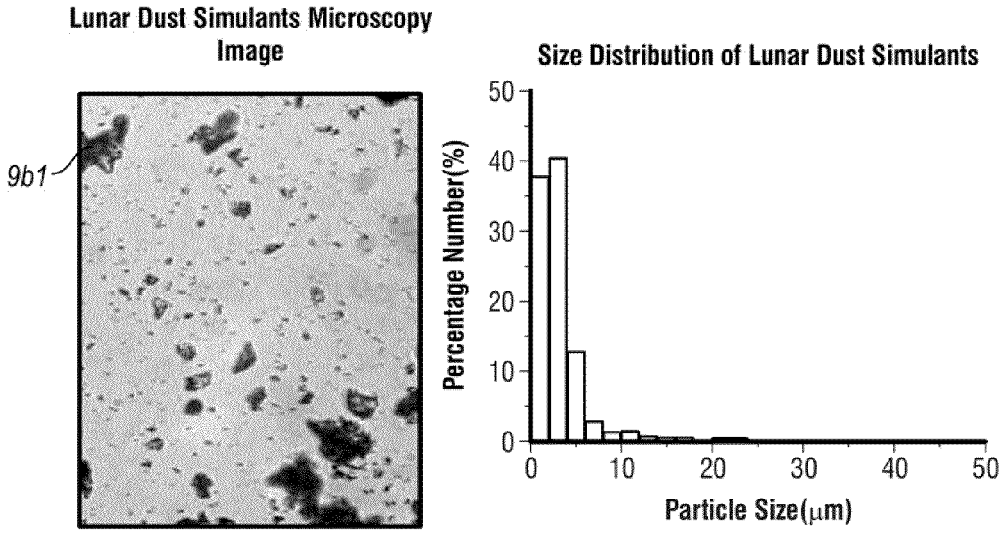
FIG. 9B is a pictorial illustration of images of Lunar dust stimulants accompanied by the percent-number size-distribution histogram.
Figure 10A:
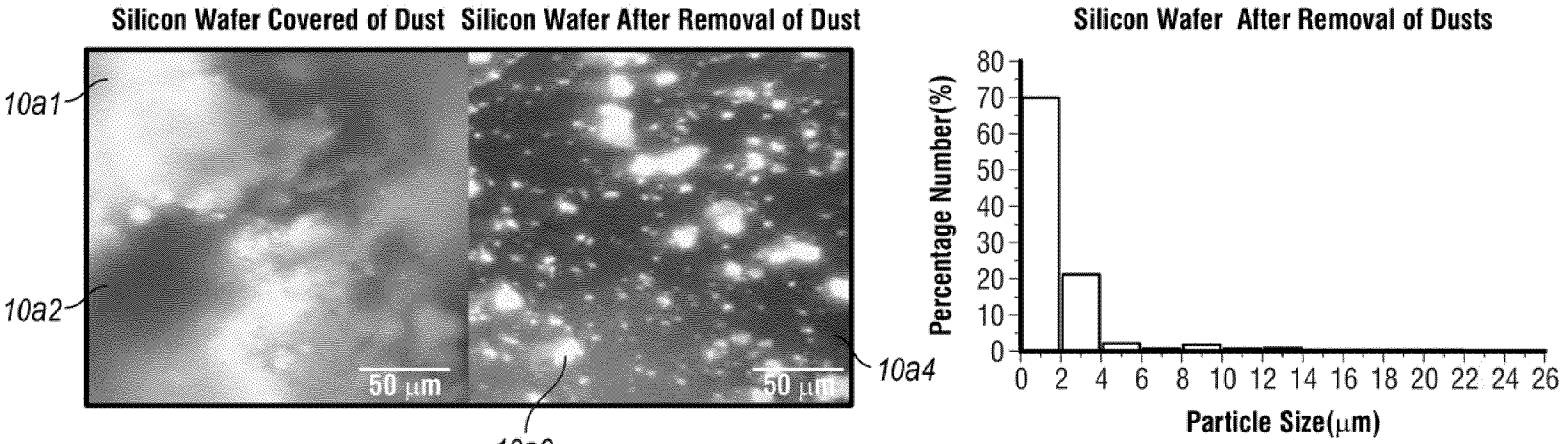
FIG. 10A is a pictorial illustration of images of dust particle removal efficiency accompanied by the percent-number size-distribution histogram for silicon wafer in accordance with the present invention shown in FIG. 1.
Figure 10B:
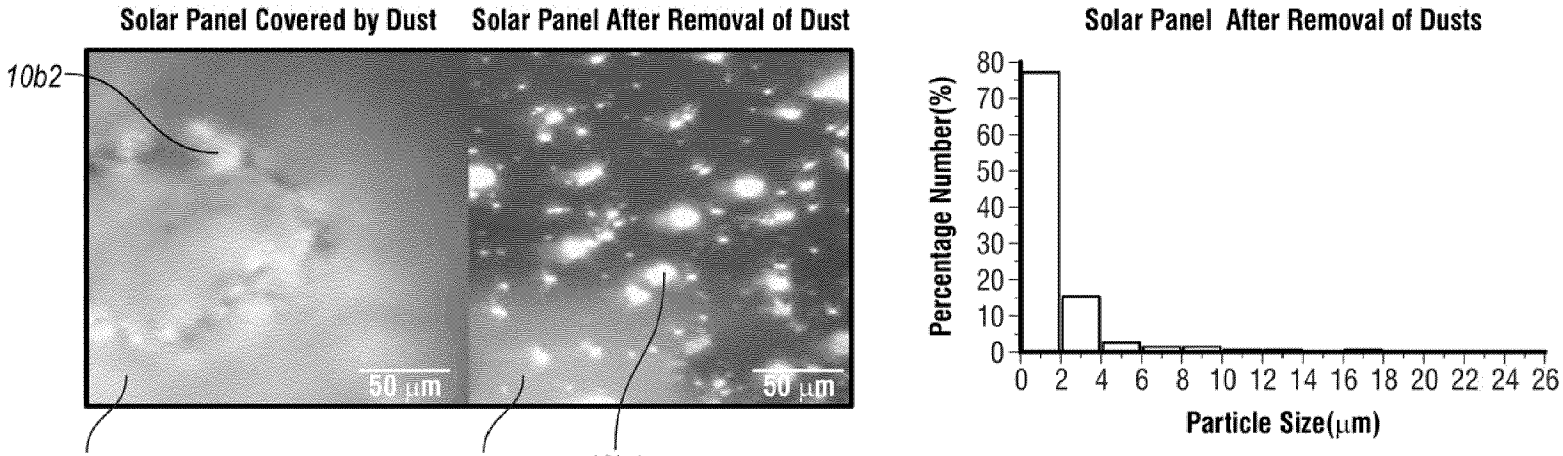
FIG. 10B is a pictorial illustration of images of dust particle removal efficiency accompanied by the percent-number size-distribution histogram for solar panel in accordance with the present invention shown in FIG. 1.
Figure 10C:
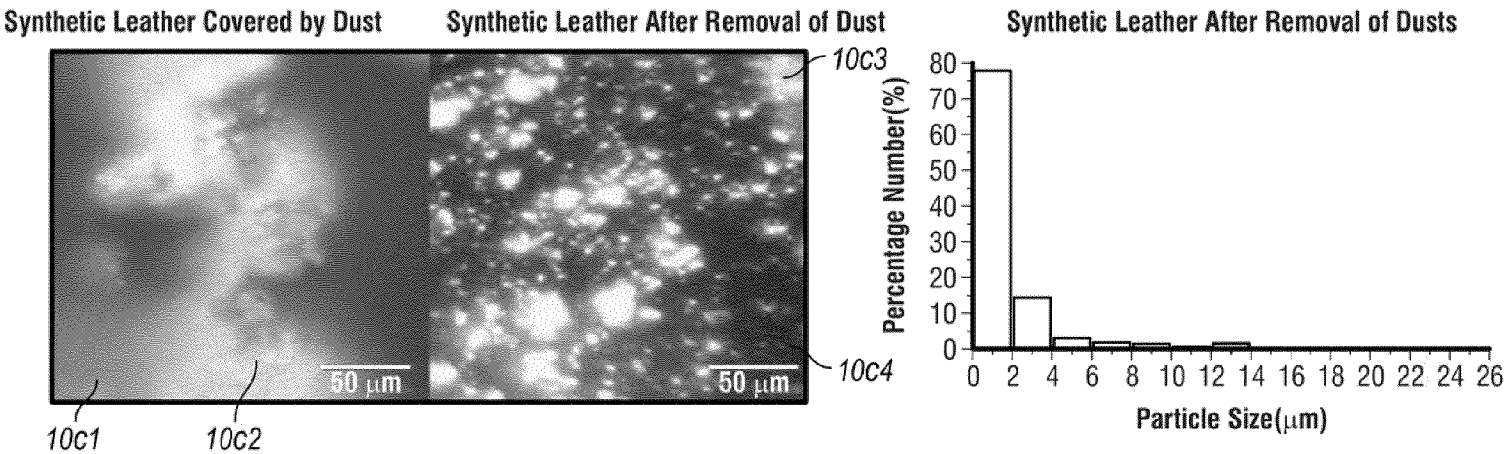
FIG. 10C is a pictorial illustration of images of dust particle removal efficiency accompanied by the percent-number size-distribution histogram for synthetic leather in accordance with the present invention shown in FIG. 1.
Figure 10D:
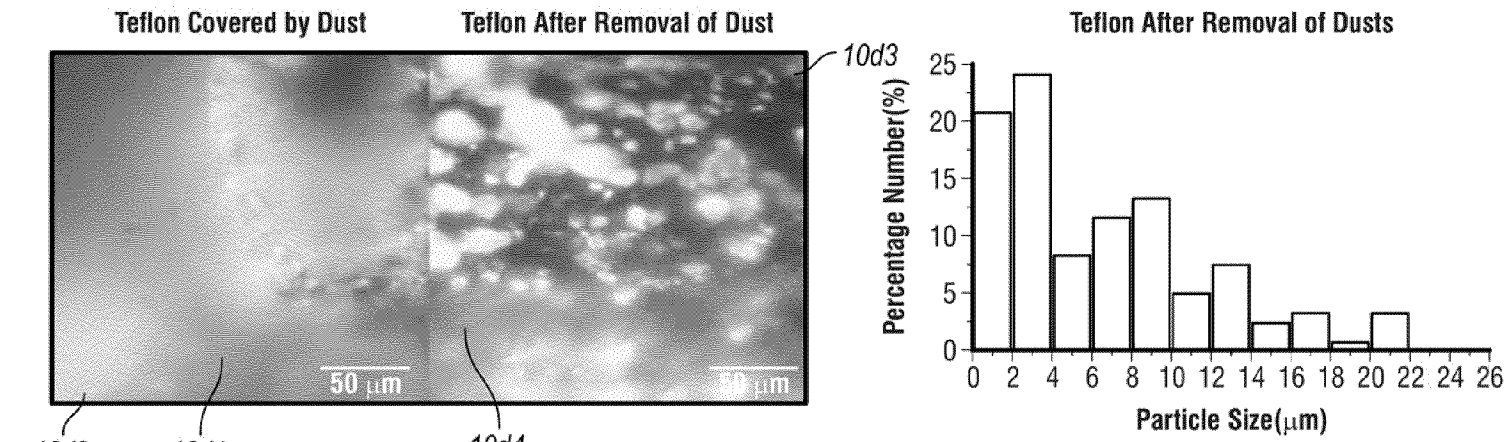
FIG 10D is a pictorial illustration of images of dust particle removal efficiency accompanied by the percent-number size-distribution histogram for Teflon in accordance with the present invention shown in FIG. 1.

Referring also to FIG. 9A there is shown a pictorial illustration of images of Mars dust stimulants accompanied with the percent-number size-distribution histogram. Likewise, also referring to FIG. 9B is a pictorial illustration of images of Lunar dust stimulants accompanied by the percent-number size-distribution histogram; The histograms of Mars and lunar dust simulants indicate that they both have a large component of particles with diameter less than 6 μm, especially in the 2-4 μm range. The percent-number of Mars dust stimulants for >4 μm is about 25% and that for 2 μm<particle-size<4 μm is about 45%. The lunar dust simulant has a similar percent-number (12% vs 14%) as the Mars dust simulant in the size range >4 μm, a lower percent number (40% vs 45%) in the size range 2 μm-4 μm, and it has more particles in the range <2 μm (38%) than Martian dust simulant has (29%).

Referring also to FIG. 10A, FIG. 10B, FIG. 10C, and FIG. 10D, there is shown a pictorial illustration of images of dust particle removal efficiency accompanied by the percent-number size-distribution histogram for silicon wafer, solar panel, synthetic leather, and Teflon, respectively, in accordance with the present invention shown in FIG. 1. As shown, there are 3 panels, for each of FIG. 10 A-D; the first two are photos of a reflector covered by Mars dust simulant taken under the microscope before and after the dust-simulants removal operation by air flow and acoustic standing wave, the third panel on the right is the size distribution histogram of the particles residual on the reflector after the removal procedure. Few particles larger than 4 μm were left (from more than 25% before the operation to less than 9% after the operation) on the silicon wafer, solar panel and synthetic leather after the removing operation as shown in FIG. 10 A-C. Particle-number in the range of 2-4 μm was also dramatically reduced from 46% to around 20% on silicon wafer and 15% on the solar-panel and leather surfaces. Small particles whose size was less than 2 μm dominated in the residuals.

Figure 11:
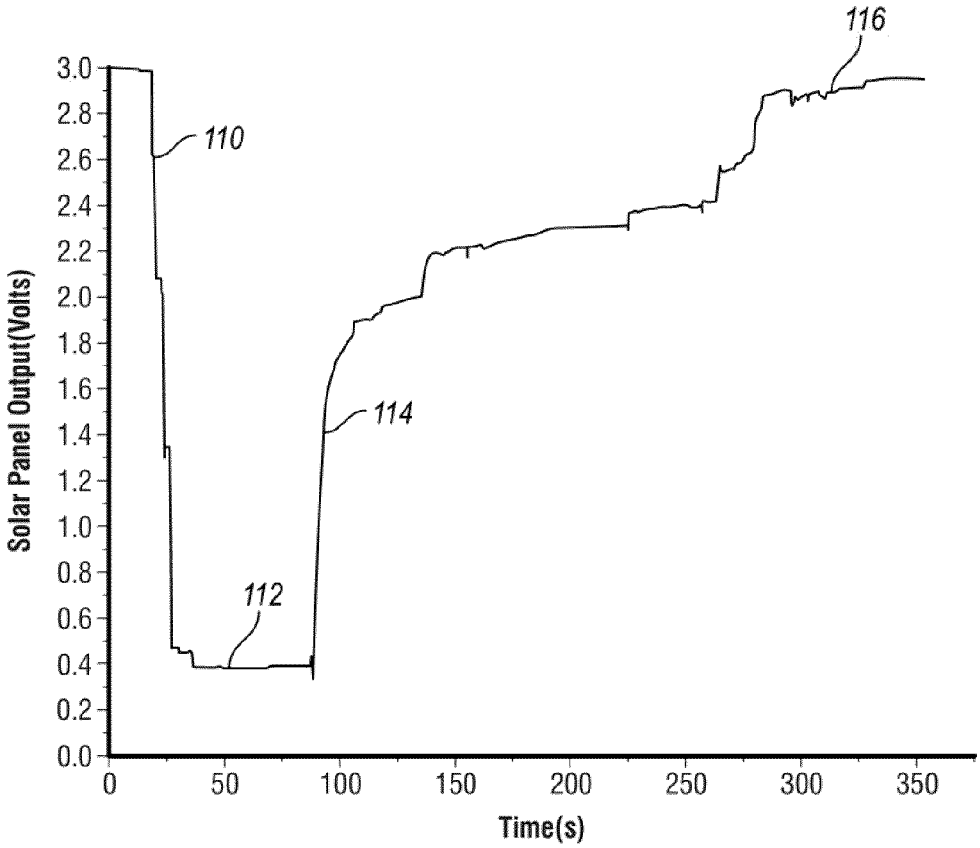
FIG. 11 is a graph of solar panel voltage output versus time as dust is removed in accordance with the present invention shown in FIG. 1.

Referring also to FIG. 11 there is shown a graph of solar panel voltage output versus time as dust is removed in accordance with the present invention shown in FIG. 1 The graph reflects the solar panel voltage output changed with time as the Mars dust simulants were sprayed on the surface and gradually removed from it by the combination of acoustic standing wave effect and airflow method. There was a significant drop in solar panel output voltage 110 (below 15% of its initial voltage of 3 V) due to the deposition and coverage of Mars dust simulants. The output voltage remained constant 112 in time until the air flow and acoustic field were applied at t=90 s. The output-voltage of the solar panel restored quickly to 65% of 3 V in first 20 seconds 114, then increased gradually up to 98.4% 116 after 4 minutes It should be understood that the foregoing description is only illustrative of the invention. For example, tweeter 5*a*2 shown in FIG. 5*a* may be one or more suitable acoustic generators for generating continuous wave (CW) acoustic, signals at multiple frequencies and amplitudes, generating frequency modulated (FM) acoustic signals at multiple frequencies and amplitudes, or a combination of CW and FM acoustic signals for specified time intervals. Similarly, bounded vortex generator 5*a*4 shown in FIG. 5*a* may include variable air flow generator and adjustable air flow jets. Thus, various alternatives and modifications can be devised by those skilled in the art without departing from the invention. Accordingly, the present invention is intended to embrace all such alternatives, modifications and variances that fall within the scope of the appended claims.

What is claimed is:

1. An apparatus for efficiently removing dust particles from a surface without direct contact, the apparatus comprising:
- a tweeter comprising having at least one acoustic generator for generating sound waves; and
- a bounded vortex generator coupled to the tweeter, wherein the bounded vortex generator comprises:
  - a central axis;
  - at least one vacuum port oriented along the central axis for providing dust removing suction;
  - an acoustic emitter concentric with the bounded vortex generator for emitting acoustic energy provided by the tweeter;
  - a plurality of tilted jets surrounding the acoustic emitter for providing an air flow substantially tangential to a surface below the bounded vortex generator and oriented to induce a vortex air motion about the central axis concentric to the bounded vortex generator; and
  - wherein the acoustic emitter is arranged to provide acoustic radiation normal to the surface below the bounded vortex generator to levitate dust particles and break their adhesive bonds to the surface wherein the at least one vacuum port suction and the plurality of tilted jets blowing operate conjunctively to form a standing vortex with a high shear stress region tangential to the surface to efficiently remove the dust particles.

2. The apparatus as in claim 1, wherein the at least one acoustic generator comprises at least one continuous wave (CW) acoustic generator.

3. The apparatus as in claim 2, wherein the at least one CW acoustic generator comprises at least one amplitude variable CW acoustic generator.

4. The apparatus as in claim 1, wherein the at least one acoustic generator comprises at least one frequency modulated (FM) acoustic generator.

5. The apparatus as claim 4, wherein the at least one FM generator comprises at least one amplitude variable FM acoustic generator.

6. The apparatus as in claim 1, wherein the plurality of tilted jets comprises a plurality of adjustable tilted jets.

7. A system for efficiently removing dust particles from a surface without direct contact, wherein the system comprises:
- a tweeter comprising:
- at least one acoustic generator for generating acoustic signals, wherein the at least one acoustic generator comprises:
  - at least one continuous wave (CW) acoustic generator;
  - at least one frequency modulated (FM) acoustic generator;

a bounded vortex generator coupled to the tweeter, wherein the bounded vortex generator comprises:

a central axis;

at least one vacuum port oriented along the central axis for providing dust removing suction;

an acoustic emitter concentric with the bounded vortex generator for radiating the acoustic signals provided by the tweeter;

a plurality of tilted jets surrounding the acoustic emitter for providing an air flow substantially tangential to a surface below the bounded vortex generator and oriented to induce a vortex air motion about the central axis concentric to the bounded vortex generator; and wherein the acoustic emitter is arranged to radiate the acoustic signals normal to the surface below the bounded vortex generator to levitate dust particles and break their adhesive bonds to the surface, wherein the at least one vacuum port suction and the plurality of tilted jets providing tangential air flow operate conjunctively to form a standing vortex with a high shear stress region tangential to the surface to efficiently remove the dust particles.

8. A system as in claim 7, wherein the at least one continuous wave (CW) acoustic generator comprises at least one amplitude variable CW acoustic generator.

9. A system as in claim 7, wherein the at least one frequency modulated (FM) acoustic generator comprises at least one amplitude variable FM acoustic generator.

10. A system as in claim 7, wherein the plurality of tilted jets comprise a plurality of adjustable tilted jets.

* * * * *